US007282468B2

(12) United States Patent
Sakizadeh et al.

(10) Patent No.: US 7,282,468 B2
(45) Date of Patent: Oct. 16, 2007

(54) DIRECT THERMOGRAPHIC MATERIALS WITH CATECHOL BORATE REDUCING AGENTS

(75) Inventors: Kumars Sakizadeh, Woodbury, MN (US); Peter J. Cowdery-Corvan, Webster, NY (US); Leif P. Olson, Rochester, NY (US); David R. Whitcomb, Woodbury, MN (US)

(73) Assignee: Carestream Health Inc., Rochester, NY (US)

( * ) Notice: Subject to any disclaimer, the term of this patent is extended or adjusted under 35 U.S.C. 154(b) by 323 days.

(21) Appl. No.: 11/183,609

(22) Filed: Jul. 18, 2005

(65) Prior Publication Data

US 2007/0015660 A1 Jan. 18, 2007

(51) Int. Cl.
*B41M 5/20* (2006.01)
*B41M 5/24* (2006.01)

(52) U.S. Cl. ..... 503/201; 503/212

(58) Field of Classification Search ..... None
See application file for complete search history.

(56) References Cited

U.S. PATENT DOCUMENTS

| | | | |
|---|---|---|---|
| 5,582,953 | A | 12/1996 | Uyttendaele et al. |
| 6,093,528 | A | 7/2000 | Terrell et al. |
| 2004/0007693 | A1 | 1/2004 | Moulton |

FOREIGN PATENT DOCUMENTS

| | | | |
|---|---|---|---|
| EP | 0 692 733 | B1 | 1/1996 |
| EP | 0 903 625 | B1 | 3/1999 |

*Primary Examiner*—Bruce H. Hess

(57) ABSTRACT

Non-photosensitive direct thermographic materials comprise a reducing agent that is a catechol borate compound. These compounds can reduce silver(I) ion to metallic silver to produce a dense black silver image under the short time and high temperature conditions that occur when using thermal print-heads during direct thermal printing.

20 Claims, No Drawings

DIRECT THERMOGRAPHIC MATERIALS WITH CATECHOL BORATE REDUCING AGENTS

FIELD OF THE INVENTION

This invention relates to non-photosensitive direct black-and-white thermographic materials having unique reducing agents ("developers") as part of the imaging chemistry. The invention also relates to methods of imaging such direct thermographic materials.

BACKGROUND OF THE INVENTION

Silver-containing direct thermographic imaging materials are non-photosensitive materials that are used in a recording process wherein images are generated by the direct application of thermal energy and in the absence of a processing solvent. These materials have been known in the art for many years and generally comprise a support having disposed thereon one or more imaging layers comprising (a) a relatively or completely non-photosensitive source of reducible silver ions, (b) a reducing agent composition (acting as a black-and-white silver developer) for the reducible silver ions, and (c) a suitable hydrophilic or hydrophobic binder. Thermographic materials are sometimes called "direct thermal" materials in the art because they are directly imaged by a source of thermal energy without any transfer of the energy or image to another material (such as in thermal dye transfer).

In a typical thermographic construction, the image-forming thermo-graphic layers are based on silver salts of long chain fatty acids. The preferred non-photosensitive reducible silver source is a silver salt of a long chain aliphatic carboxylic acid having from 10 to 30 carbon atoms, such as behenic acid or mixtures of acids of similar molecular weight. At elevated temperatures, the silver(I) of the silver carboxylate is reduced by a reducing agent (that is, the developer) whereby a black-and-white image of elemental silver is formed.

Problem to be Solved

As noted above, direct thermographic materials are imaged by a recording process wherein images are generated by imagewise heating a recording material containing chemical components that provide an optical density change in an imagewise fashion. The chemical components include a reducing agent as noted above. Many compounds have been described in the art that are considered useful for this purpose. They are often compounds having at least two adjacent hydroxy substituents as described, for example, in U.S. Pat. No. 5,582,953 (Uyttendaele et al.) and U.S. Pat. No. 6,093,528 (Terrell et al.).

The phenolic reducing agents of the prior art have varying usefulness, and vary in their light stability, resistance to aerial oxidation, tint and/or tone of the developed silver image, and their ability to produce a dense black metallic silver image under the short time and high temperature conditions that occur during thermal printing.

A particular problem with thermographic materials is their change in tint and tone upon storage. The initial blue-black image typically becomes more red-black in color upon storage. Thus, a challenge in designing thermo-graphic materials is the need to improve the "Dark Stability" of the imaged and processed thermographic film upon storage. It is desirable that the Dmin not increase, and that the Dmax, tint, and tone of the image not change.

Thus, there remains a continuing need to provide improved black-and-white imaging chemistry including reducing agents for direct thermographic materials that generate a dense neutral and storage stable black metallic silver image upon thermal imaging.

SUMMARY OF THE INVENTION

This invention provides a black and white non-photosensitive direct thermographic material comprising a support and on one or both sides thereof, one or more thermally sensitive imaging layers having in reactive association, a non-photosensitive source of reducible silver ions and a catechol borate compound reducing agent for the reducible silver ions.

In preferred embodiments a black and white non-photosensitive direct thermographic material comprises a transparent support and on the frontside thereof, one or more thermally sensitive imaging layers having in reactive association, a non-photosensitive source of reducible silver ions that includes one or more silver carboxylates, one of which is silver behenate, a catechol borate reducing agent represented by the following Structure (I):

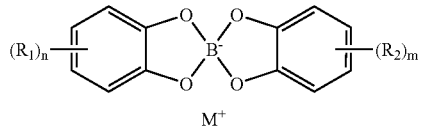

wherein $R_1$ and $R_2$ are independently halo, nitro, cyano, alkylsulfonyl, or arylsulfonyl groups, n and m are both 1, and $M^+$ represents alkali metal cation, an overcoat layer that is the outermost layer of the material and comprises matte particles, one or more silicone oils of category (d), and one or more compounds from any of the following categories (a), (b), and (c):

(a) solid polymers, each derived from one or more olefins and from one or more ethylenically unsaturated polymerizable carboxylic acids or esters or anhydrides thereof, (b) branched α-olefin polymers, (c) additional waxes other than compounds in categories of (a) and (b), and (d) silicone oils, and having a conductive layer comprising non-acicular metal antimonate particles composed of $ZnSb_2O_6$ on the backside side of the transparent support.

This invention also provides a method comprising imaging the direct thermographic material of the present invention with a thermal imaging source (such as thermal printhead) to provide a visible image.

Where the direct thermographic material comprises a transparent support, the image-forming method can further comprise:

positioning the imaged thermographic material with the visible image thereon between a source of imaging radiation and an imageable material that is sensitive to the imaging radiation, and thereafter exposing the imageable material to the imaging radiation through the visible image in the imaged thermographic material to provide an image in the imageable material.

The method of this invention can be used to provide a visible image useful for medical diagnostic purposes.

The present invention provides direct thermographic materials that contain novel reducing agents that produce a dense black silver image under the short time and high temperature conditions that occur when using thermal print-heads during thermal printing. These materials show little change in Dmin, Dmax, tint, and tone upon storage.

DETAILED DESCRIPTION OF THE INVENTION

The direct thermographic materials can be used to provide black-and-white silver images using non-photosensitive silver salts, specific reducing agents, binders, and other components known to be useful in such materials.

The direct thermographic materials can be used in black-and-white thermography and in electronically generated black-and-white hardcopy recording. They can be used as output media, in radiographic imaging (for example digital medical imaging), X-ray radiography, and in industrial radiography. Furthermore, the absorbance of these thermographic materials between 350 and 450 nm is desirably low (less than 0.5), to permit their use in the graphic arts area (for example, in imagesetting and phototypesetting operations), in the manufacture of printing plates, in contact printing, in duplicating ("duping"), and in proofing.

The direct thermographic materials are particularly useful as output media for medical imaging of human or animal subjects in response to visible or X-radiation for diagnostic purposes. Such applications include, but are not limited to, thoracic imaging, mammography, dental imaging, orthopedic imaging, general medical radiography, therapeutic radiography, veterinary radiography, and auto-radiography.

In the direct thermographic materials, the components needed for imaging can be in one or more thermally sensitive layers on one side ("frontside") of the support. The layer(s) that contain the non-photosensitive source of reducible silver ions, or both, are referred to herein as thermographic emulsion layer(s) or thermally sensitive imaging layer(s).

Where the materials contain thermographic imaging layers on one side of the support only, various non-imaging layers can be disposed on the "backside" (non-emulsion or non-imaging side) of the materials, such as primer layers, interlayers, opacifying layers, subbing layers, carrier layers, auxiliary layers, protective layers, and/or conductive layers. Particularly important non-imaging layers include a backside conductive layer and an outermost backside protective layer.

In such embodiments, various non-imaging layers can also be disposed on the "frontside," imaging, or emulsion side of the support, including primer layers, interlayers, opacifying layers, subbing layers, carrier layers, auxiliary layers, protective overcoat layers, and other layers readily apparent to one skilled in the art. Particularly important non-imaging frontside layers include carrier layers and outermost protective overcoat layers.

In some embodiments, the direct thermographic materials are "double-sided" and have thermographic, emulsion, or thermally sensitive imaging layer(s) on both sides of the support. In such constructions, each side can also include one or more carrier layers, primer layers, adhesive layers, interlayers, antistatic or conductive layers, auxiliary layers, and other layers readily apparent to one skilled in the art. An outermost protective layer can be on either or both sides of the support.

Definitions

As used herein:

In the descriptions of the thermographic materials, "a" or "an" component refers to "at least one" of that component (for example, the catechol borate reducing agents described below).

The term "black-and-white" refers to an image formed by silver metal.

"Thermographic material(s)" means a dry processable integral element comprising a support having at least one thermographic emulsion layer or a set of thermographic emulsion layers, (wherein the source of reducible silver ions is in one layer and other components or additives are distributed, as desired, in the same layer or in one or more additional coated layer), that provides a black-and-white silver image. Such additional layers include protective overcoat layers, carrier layers, conductive layers, and subbing or priming layers. These materials preferably have at least one outermost protective layer on the imaging side that is in direct contact with the imaging means during thermal imaging. These materials also include multilayer constructions in which one or more imaging components are in different thermographic layers, but are in "reactive association." For example, one layer can include the non-photosensitive source of reducible silver ions and another layer can include the reducing agent, but the two reactive components are in reactive association with each other. Preferably these materials have at least one outermost protective layer as described herein above all thermographic layers. By "integral," we mean that all imaging chemistry required for imaging is in the material without diffusion of imaging chemistry or reaction products (such as a dye) from or to another element (such as a receiver element).

Also, unless otherwise indicated, the terms "thermographic material" and "direct thermographic materials" are meant to refer to embodiments of the present invention.

When used in thermography, the term, "imagewise exposing" or "imagewise exposure" means that the material is imaged using any means that provides an image using heat. This includes, for example, analog exposure where an image is formed by differential contact heating through a mask using a thermal blanket or infrared heat source, as well as by digital exposure where the image is formed one pixel at a time such as by modulation of thermal print-heads or by thermal imaging with a modulated scanning laser beam.

The materials described herein are direct thermographic materials that are imaged using a digital exposure and thermal imaging is carried out in a single thermographic material containing all of the necessary imaging chemistry. Direct thermal imaging is distinguishable from what is known in the art as thermal transfer imaging (such as dye transfer imaging) in which the image is produced in one material ("donor") and transferred to another material ("receiver") using thermal means.

"Catalytic proximity" or "reactive association" means that the reactive components are in the same layer or in adjacent layers so that they readily come into contact with each other during thermal imaging and development.

"Emulsion layer," "imaging layer," "thermographic layer," or "thermographic emulsion layer," means a thermally sensitive layer of a thermographic material that contains the non-photosensitive source of reducible silver ions. It can also mean a layer of the thermographic material that contains, in addition to the non-photosensitive source of reducible ions, additional desirable components. These layers are usually on what is known as the "frontside" of the support.

The frontside protective layer is the outermost layer on the imaging side of the material that is in direct contact with the imaging means. The backside protective layer is the outermost layer on the side of the support opposite to that containing the imaging layer(s).

"Non-photosensitive" means not intentionally light sensitive. The direct thermographic materials described herein are non-photosensitive meaning that no photosensitive silver halide(s) has been purposely added or created.

"Simultaneous coating" or "wet-on-wet" coating means that when multiple layers are coated, subsequent layers are coated onto the initially coated layer before the initially coated layer is dry.

The sensitometric terms, absorbance, contrast, Dmin, and Dmax have conventional definitions known in the imaging arts. In thermographic materials, Dmin is considered herein as image density in the areas with the minimum application of heat by the thermal print-head. The term Dmax is the maximum image density achieved when the thermographic material is thermally imaged with a given amount of thermal energy. The sensitometric term absorbance is another term for optical density (OD).

Image tone is defined by the known CIELAB color system (Commission Internationale de l'Eclairage) as discussed in detail in *Principles of Color Technology,* $2^{nd}$ Ed., Billmeyer and Saltzman, John Wiley & Sons, 1981. In this color system, color space is defined in terms of L*, a*, and b* wherein L* is a measure of the luminance or lightness of a given color, a* is a measure of the red-green contribution, and b* is a measure of the yellow-blue contribution. In a two-dimension plot of a* versus b*, a more negative a* provides a greener tone and a more negative b* provides a bluer ("colder") tone. Conversely, a more positive a* provides a more reddish tone and a more positive b* provides a more yellowish ("warmer") tone. Neutral tone is defined wherein a* and b* are both zero. In black-and-white thermography, as optical density increases, a* and b* tend toward zero. Image tone a* and b* values can be measured using conventional methods and equipment, such as a HunterLab UltraScan Colorimeter.

Another tone parameter is h(ab), or hue angle, that is equal to arctan(b*/a*), as measured at an optical density of 1.0, and as defined in the CIELAB color system.

"Transparent" means capable of transmitting visible light or imaging radiation without appreciable scattering or absorption.

The phrases "silver salt" and "organic silver salt" refer to an organic molecule having a bond with a silver atom. Although the compounds so formed are technically silver coordination complexes or silver compounds they are often referred to as silver salts.

The terms "double-sided," "double-faced coating," and "duplitized" are used to define thermographic materials having one or more of the same or different thermographic disposed on both sides (frontside and backside) of the support.

As is well understood in this art, for the chemical compounds herein described, substitution is not only tolerated, but is often advisable and various substituents are anticipated on the compounds used in the present invention unless otherwise stated. Thus, when a compound is referred to as "having the structure" of a given formula, any substitution that does not alter the bond structure of the formula or the shown atoms within that structure is included within the formula, unless such substitution is specifically excluded by language (such as "free of carboxy-substituted alkyl").

As a means of simplifying the discussion and recitation of certain substituent groups, the term "group" refers to chemical species that may be substituted as well as those that are not so substituted. Thus, the term "alkyl group" is intended to include not only pure hydrocarbon alkyl chains, such as methyl, ethyl, n-propyl, t-butyl, cyclohexyl, iso-octyl, and octadecyl, but also alkyl chains bearing substituents known in the art, such as hydroxyl, alkoxy, phenyl, halogen atoms (F, Cl, Br, and I), cyano, nitro, amino, and carboxy. For example, alkyl group can include ether and thioether groups (for example $CH_3$—$CH_2$—$CH_2$—O—$CH_2$— and $CH_3$—$CH_2$—$CH_2$—S—$CH_2$—), haloalkyl, nitroalkyl, alkylcarboxy, carboxyalkyl, carboxamido, hydroxyalkyl, sulfoalkyl, and other groups readily apparent to one skilled in the art. A skilled artisan would exclude substituents that adversely react with other active ingredients as not being inert or harmless.

*Research Disclosure* (http://www.researchdisclosure.com) is a publication of Kenneth Mason Publications Ltd., The Book Barn, Westbourne, Hampshire PO10 8RS, UK. It is also available from Emsworth Design Inc., 200 Park Avenue South, Room 1101, New York, N.Y. 10003.

Other aspects, advantages, and benefits of the present invention are apparent from the detailed description, examples, and claims provided in this application.

Non-Photosensitive Source of Reducible Silver Ions

The non-photosensitive source of reducible silver ions used in the direct thermographic materials can be any silver-organic compound that contains reducible silver(I) ions. Such compounds are generally silver salts of silver coordinating ligands. Preferably, it is an organic silver salt that is comparatively stable to light and forms a silver image when heated to 50° C. or higher in the presence of a reducing agent. Mixtures of the same or different types of silver salts can be used if desired.

Silver salts of organic acids including silver salts of long-chain carboxylic acids are preferred. The chains typically contain 10 to 30, and preferably 15 to 28, carbon atoms. Suitable organic silver salts include silver salts of organic compounds having a carboxylic acid group. Examples thereof include a silver salt of an aliphatic carboxylic acid or a silver salt of an aromatic carboxylic acid. Preferred examples of the silver salts of aliphatic carboxylic acids include silver behenate, silver arachidate, silver stearate, silver oleate, silver laurate, silver caprate, silver myristate, silver palmitate, silver maleate, silver fumarate, silver tartarate, silver furoate, silver linoleate, silver butyrate, silver camphorate, and mixtures thereof. Preferably, silver behenate is used alone or in mixtures with other silver salts.

In some embodiments, a highly crystalline silver behenate can be used as part or all of the non-photosensitive sources of reducible silver ions, as described in U.S. Pat. No. 6,096,486 (Emmers et al.) and U.S. Pat. No. 6,159,667 (Emmers et al.), both incorporated herein by reference. Moreover, the silver behenate can be used in its one or more crystallographic phases (such as a mixture of phases I, II and/or III) as described in U.S. Pat. No. 6,677,274 (Geuens et al.) that is incorporated herein by reference.

Other useful but less preferred silver salts include but are not limited to, silver salts of aromatic carboxylic acids and other carboxylic acid group-containing compounds, silver salts of aliphatic carboxylic acids containing a thioether group as described in U.S. Pat. No. 3,330,663 (Weyde et al.), silver carboxylates comprising hydrocarbon chains incorporating ether or thioether linkages, or sterically hindered substitution in the α-(on a hydrocarbon group) or ortho-(on an aromatic group) position, as described in U.S. Pat. No. 5,491,059 (Whitcomb), silver salts of aliphatic, aromatic, or heterocyclic dicarboxylic acids, silver salts of sulfonates as described in U.S. Pat. No. 4,504,575 (Lee), silver salts of sulfosuccinates as described in EP 0 227 141 A1 (Leenders et al.), silver salts of acetylenes as described in U.S. Pat. No. 4,761,361 (Ozaki et al.) and U.S. Pat. No. 4,775,613 (Hirai et al.), silver salts of compounds containing mercapto or thione groups and derivatives thereof (such as those having a heterocyclic nucleus containing 5 or 6 atoms in the ring, at least one of which is a nitrogen atom), as described in U.S. Pat. No. 4,123,274 (Knight et al.) and U.S. Pat. No. 3,785,830 (Sullivan et al.), silver salts of mercapto or thione substituted compounds that do not contain a heterocyclic nucleus, silver salts of compounds containing an imino group (such as silver salts of benzotriazole and substituted derivatives thereof), silver salts of 1,2,4-triazoles or 1-H-tetrazoles as described in U.S. Pat. No. 4,220,709 (deMauriac), and silver salts of imidazoles and substituted imidazoles as described in U.S. Pat. No. 4,260,677 (Winslow et al.).

It is also convenient to use silver half soaps that are blends of silver carboxylates and carboxylic acids.

The methods used for making silver soap emulsions are well known in the art and are disclosed in *Research Disclosure*, April 1983, item 22812, *Research Disclosure*, October 1983, item 23419, U.S. Pat. No. 3,985,565 (Gabrielsen et al.), and the references cited above.

Non-photosensitive sources of reducible silver ions can also be provided as core-shell silver salts such as those described in U.S. Pat. No. 6,355,408 (Whitcomb et al.), or as silver dimer compounds that comprise two different silver salts as described in U.S. Pat. No. 6,472,131 (Whitcomb), both of which are incorporated herein by reference.

Still other useful sources of non-photosensitive reducible silver ions are the silver core-shell compounds comprising a primary core comprising one or more photosensitive silver halides, or one or more non-photosensitive inorganic metal salts or non-silver containing organic salts, and a shell at least partially covering the primary core, wherein the shell comprises one or more non-photosensitive silver salts, each of which silver salts comprises a organic silver coordinating ligand. Such compounds are described in U.S. Pat. No. 6,803,177 (Bokhonov et al.) that is incorporated herein by reference.

The one or more non-photosensitive sources of reducible silver ions are preferably present in an amount of from about 5% to about 70% (more preferably, from about 10% to about 50%), based on the total dry weight of the emulsion layers. Stated another way, the amount of the sources of reducible silver ions is generally present in an amount of from about 0.001 to about 0.2 mol/m$^2$ of the thermographic material, and preferably from about 0.005 to about 0.05 mol/m$^2$ of that material.

Reducing Agents

The thermographic materials include one or more reducing agents to reduce the silver ions during imaging. The predominant reducing agents used in this invention are catechol borate compounds. By "predominant," we mean that the catechol borates described herein comprise at least 50 mol % of the total moles of reducing agents. Preferably, the catechol borates comprise at least 70 mol %, and most preferably the catechol borates comprise 100 mol % of the reducing agents.

We have found that use of catechol borate compounds as reducing agent (developers) to reduce silver(I) ion to metallic silver produces a dense black silver image under the short time and high temperature conditions that occur when using thermal print-heads during direct thermal printing. Although strictly speaking a catechol is a 1,2-dihydroxy benzene compound, catechol as used herein refers to any aromatic compound having adjacent hydroxy groups on the same aromatic ring and includes, for example, 1,2- and 2,3-dihydroxynaphthalene, 1,2- and 2,3-dihydroxyanthracene, and 1,2-dihydroxy and 2,3-dihydroxypyridine.

The preferred catechol borate reducing agents are bis-catechol borate compounds. By bis-catechol borate compound we mean a compound in which a boron atom is attached to two catechol groups. These catechol groups may have the same or have different substituents.

The preferred bis-catechol borate reducing agents useful in the present invention can be represented by the following Structure (I):

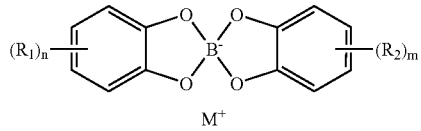

(I)

wherein $R_1$ or $R_2$ independently represent hydrogen or a monovalent substituent, or adjacent $R_1$ or $R_2$ independently represent the number of atoms necessary to form a 5- or 6-membered ring fused to the illustrated rings, n and m independently represent an 0 or an integer from 1 to 4, and $M^+$ represents a metal cation or ammonium. $R_1$ and $R_2$ can be same or different substituents and when n or m is 2 or more, the adjacent $R_1$ groups and the adjacent $R_2$ groups can be the same or different on each side of the molecule, or they can form the same or different fused rings.

$R_1$ and $R_2$ independently represent hydrogen or a substituent such as alkyl, aryl, alkoxy, thioalkoxy, alkyl and arylcarbonyl, alkylsulfonyl and arylsulfonyl (such as methylsulfonyl, trifluoromethyl sulfonyl, and phenylsulfonyl), alkyl and aryl sulfoxide, carboxamido (including amido, alkyl and aryl carbamido, dialkyl and diaryl carbamido, and alkyl-aryl-carboxamido), alkoxycarbonyl and aryloxycarbonyl groups (such as methoxycarbonyl and phenoxycarbonyl), halo (such as fluoro, chloro, bromo, and iodo), nitro, nitroso, cyano, perhaloalkyl (such as trichloromethyl and trifluoromethyl), alkyl and aryl aminosulfonyl (such as methyl and phenyl aminosulfonyl), alkyl and aryl imino, carboxy, and carboxylic acid. Preferably $R_1$ and $R_2$ are independently halo (such as fluoro, chloro, bromo, and iodo), nitro, cyano, alkylsulfonyl or arylsulfonyl groups. More preferably, all of the $R_1$ and $R_2$ groups are the same. Most preferably, both of $R_1$ and $R_2$ are cyano.

Preferably, m and n are 0, 1, or 2. More preferably m and n are 1.

$M^+$ is a cation such as a metal cation or an ammonium cation. Ammonium cations can be substituted with one or more organic groups. Preferably $M^+$ is an alkali metal cation such as $Li^+$, $Na^+$, or $K^+$, or a tetraalkyl-ammonium cation. More preferably, $M^+$ is $Li^+$.

The preferred bis-catechol borates can be prepared by mixing, equimolar amounts of lithium hydroxide and boric acid, and 2 equivalents of a catechol compound in water and heating to near boiling until all the reactants dissolve and a clear homogeneous solution is obtained. After few minutes, the solution is cooled to room temperature and a large quantity of solid precipitates. The supernatant solution is decanted and the solid is recrystallized from an appropriate solvent. The tetraalkylammonium salts are prepared in a similar manner. The 2 equivalents of catechol compound can be made up of one or more catechol compounds. Additional bis-catechol borates can be prepared from the catechols described in, for example, U.S. Pat. No. 5,582,953 (Uyttendaele et al.) and U.S. Pat. No. 6,093,528 (Terrell et al.), both of which are incorporated herein by reference. The preparation of specific catechol borates is further described below.

Representative catechol borates useful in the practice of the present invention include the following compounds CB-1 through CB-16:

(CB-1)

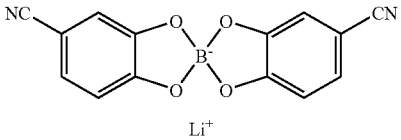

(CB-2)

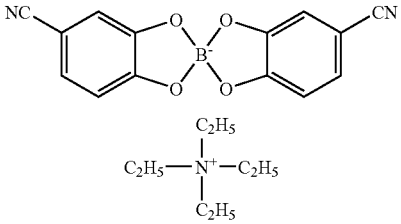

(CB-3)

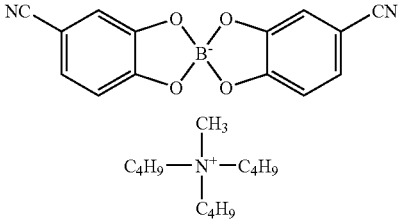

(CB-4)

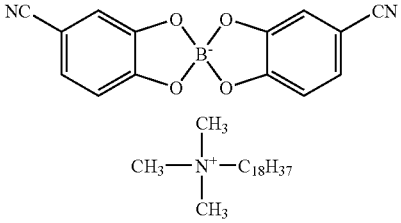

(CB-5)

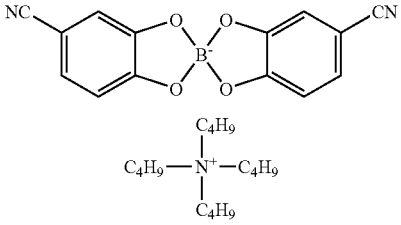

-continued (CB-6)

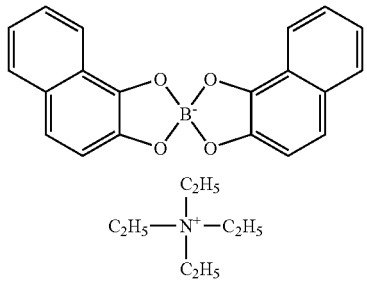

(CB-7)

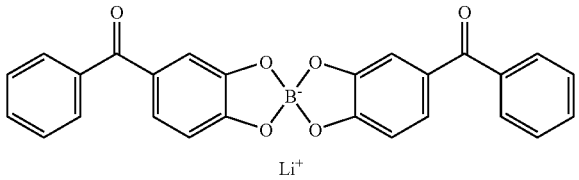

(CB-8)

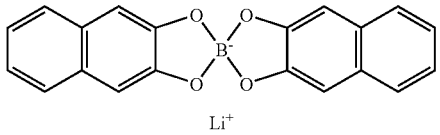

(CB-9)

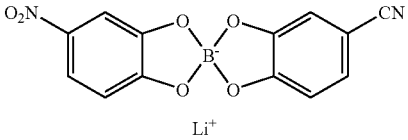

(CB-10)

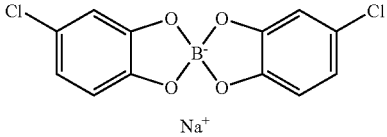

(CB-11)

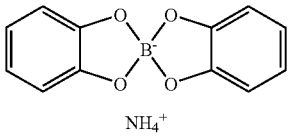

(CB-12)

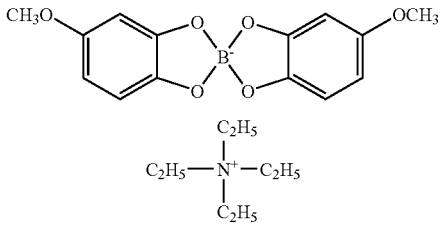

(CB-13)

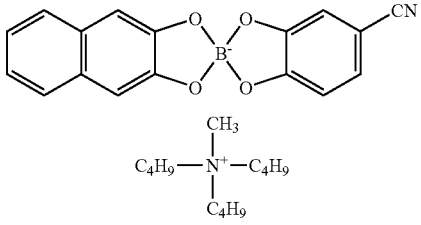

-continued (CB-14)

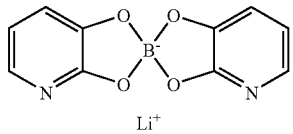

(CB-15)

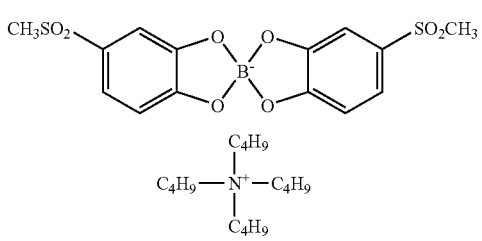

(CB-16)

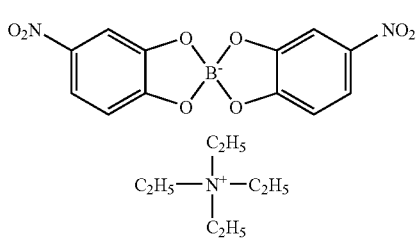

Compounds CB-1, CB-2, and CB-4 are preferred. Compound CB-1 is most preferred.

The catechol borate reducing agents described herein are present in an amount of at least 0.03 mol/mol of total silver. Preferably, they are present in an amount of from about 0.05 to about 2.0 mol/mol of total silver.

The catechol borates can be incorporated into any layer on the imaging side of the support and they can be incorporated into one or more layer(s) and allowed to diffuse into other others. Preferably, the catechol borate is in the thermally sensitive imaging layer with the non-photosensitive source of reducible silver ions.

Other reducing agents can be present in mixture with the catechol borates, or in different imaging layers, if desired in "minor" amounts (less than 50 mol % of the total reducing agents). Such reducing agents are well known to those skilled in the art and include, for example, aromatic di- and tri-hydroxy compounds having at least two hydroxy groups in ortho- or para-relationship on the same aromatic nucleus such as hydroquinone and substituted hydroquinones, catechols, pyrogallol, gallic acid and gallic acid esters (for example, methyl gallate, ethyl gallate, propyl gallate), and tannic acid.

Specific compounds of this type include 2,3-dihydroxybenzoic acid, and 2,3-dihydroxy-benzoic acid esters (such as methyl 2,3-dihydroxy-benzoate, and ethyl 2,3-dihydroxybenzoate). Additional examples include, 3,4-dihydroxy-benzoic acid, 3-(3,4-dihydroxy-phenyl)-propionic acid, 3,4-dihydroxy-benzoic acid esters (such as methyl 3,4-dihydroxybenzoate, and ethyl 3,4-dihydroxy-benzoate), 3,4-dihydroxy-benzaldehyde, 3,4-dihydroxy-benzonitrile, and phenyl-(3,4-dihydroxyphenyl)ketone as described, for example, in U.S. Pat. No. 5,582,953 (Uyttendaele et al.). Still another class of reducing agents includes polyhydroxy spiro-bis-indane compounds described as photographic tanning agents in U.S. Pat. No. 3,440,049 (Moede). Further reducing agents include certain ortho-amino-phenol, para-amino-phenol, and hydroquinone (that is, para-hydroxyphenol) compounds described in copending and commonly assigned U.S. Ser. No. 11/012,788 (filed Dec. 15, 2004 by Whitcomb, Olson, Cowdery-Corvan, Sakizadeh, and Ishida). The above patents and patent application are all incorporated herein by reference.

Other Addenda

The direct thermographic materials can also contain other additives such as toners, shelf-life stabilizers, contrast enhancers, dyes or pigments, post-processing stabilizers or stabilizer precursors, thermal solvents (also known as melt formers), and other image-modifying agents as would be readily apparent to one skilled in the art.

Suitable stabilizers that can be used alone or in combination include thiazolium salts as described in U.S. Pat. No. 2,131,038 (Staud) and U.S. Pat. No. 2,694,716 (Allen), azaindenes as described in U.S. Pat. No. 2,886,437 (Piper), triazaindolizines as described in U.S. Pat. No. 2,444,605 (Heimbach), the urazoles described in U.S. Pat. No. 3,287,135 (Anderson), sulfocatechols as described in U.S. Pat. No. 3,235,652 (Kennard), the oximes described in GB 623,448 (Carrol et al.), polyvalent metal salts as described in U.S. Pat. No. 2,839,405 (Jones), thiuronium salts as described in U.S. Pat. No. 3,220,839 (Herz), palladium, platinum, and gold salts as described in U.S. Pat. No. 2,566,263 (Trirelli) and U.S. Pat. No. 2,597,915 (Damshroder), and compounds having —$SO_2CBr_3$ groups as described in U.S. Pat. No. 5,369,000 (Sakizadeh et al.), U.S. Pat. No. 5,464,737 (Sakizadeh et al.), U.S. Pat. No. 5,594,143 (Kirk et al.) and U.S. Pat. No. 5,374,514 (Kirk et al.), and U.S. Pat. No. 5,460,938 (Kirk et al.).

Stabilizer precursor compounds capable of releasing stabilizers upon application of heat during imaging can also be used, as described in U.S. Pat. No. 5,158,866 (Simpson et al.), U.S. Pat. No. 5,175,081 (Krepski et al.), U.S. Pat. No. 5,298,390 (Sakizadeh et al.), and U.S. Pat. No. 5,300,420 (Kenney et al.).

In addition, certain substituted-sulfonyl derivatives of benzo-triazoles may be used as stabilizing compounds as described in U.S. Pat. No. 6,171,767 (Kong et al.).

The direct thermographic materials may also include one or more thermal solvents (or melt formers). Combinations of these compounds can also be used such as a combination of succinimide and dimethylurea. Known thermal solvents are disclosed in U.S. Pat. No. 3,438,776 (Yudelson), U.S. Pat. No. 5,250,386 (Aono et al.), U.S. Pat. No. 5,368,979 (Freedman et al.), U.S. Pat. No. 5,716,772 (Taguchi et al.), and U.S. Pat. No. 6,013,420 (Windender).

"Toners" or derivatives thereof that improve the image are highly desirable components of the thermographic materials. These compounds, when added to the imaging layer, shift the color of the image from yellowish-orange to brown-black or blue-black. Generally, one or more toners described herein are present in an amount of from about 0.01% to about 10% (more preferably from about 0.1% to about 10%), based on the total dry weight of the layer in which the toner is included. Toners may be incorporated in the thermographic emulsion layer or in an adjacent non-imaging layer.

Compounds useful as toners are described in U.S. Pat. No. 3,080,254 (Grant, Jr.), U.S. Pat. No. 3,847,612 (Winslow), U.S. Pat. No. 4,123,282 (Winslow), U.S. Pat. No. 4,082,901 (Laridon et al.), U.S. Pat. No. 3,074,809 (Owen), U.S. Pat. No. 3,446,648 (Workman), U.S. Pat. No. 3,844,797 (Willems et al.), U.S. Pat. No. 3,951,660 (Hagemann et al.), and U.S. Pat. No. 5,599,647 (Defieuw et al.), and GB 1,439,478 (AGFA).

Additional useful toners are substituted and unsubstituted mercaptotriazoles as described in U.S. Pat. No. 3,832,186 (Masuda et al.), U.S. Pat. No. 5,149,620 (Simpson et al.), U.S. Pat. No. 6,165,704 (Miyake et al.), U.S. Pat. No. 6,713,240 (Lynch et al.), and U.S. Pat. No. 6,841,343 (Lynch et al.), all of which are incorporated herein by reference.

Phthalazine and phthalazine derivatives [such as those described in U.S. Pat. No. 6,146,822 (Asanuma et al.), incorporated herein by reference], phthalazinone, and phthalazinone derivatives are particularly useful toners.

Toners particularly useful in aqueous-coated systems include the phthalazine compounds described in U.S. Pat. No. 6,605,418 (Ramsden et al.), the triazine thione compounds described in U.S. Pat. No. 6,703,191 (Lynch et al.), and the heterocyclic disulfide compounds described in U.S. Pat. No. 6,737,227 (Lynch et al.), all of which are incorporated herein by reference.

The thermographic materials can also include one or more image stabilizing compounds that are usually incorporated in a "backside" layer. Such compounds can include phthalazinone and its derivatives, pyridazine and its derivatives, benzoxazine and benzoxazine derivatives, benzothiazine-dione and its derivatives, and quinazoline-dione and its derivatives, particularly as described in U.S. Pat. No. 6,599,685 (Kong). Other useful backside image stabilizers include anthracene compounds, coumarin compounds, benzophenone compounds, benzotriazole compounds, naphthalic acid imide compounds, pyrazoline compounds, or compounds described in U.S. Pat. No. 6,465,162 (Kong et al.) and GB 1,565,043 (Fuji Photo).

The thermographic materials may also include one or more polycarboxylic acids and/or anhydrides thereof that are in thermal working relationship with the sources of reducible silver ions in the one or more thermally sensitive imaging layers. Such polycarboxylic acids can be substituted or unsubstituted aliphatic (such as glutaric acid and adipic acid) or aromatic compounds and can be present in an amount of at least 5 mol % ratio to silver. They can be used in anhydride or partially esterified form as long as two free carboxylic acids remain in the molecule. Useful polycarboxylic acids are described for example in U.S. Pat. No. 6,096,486 (noted above).

Binders

The non-photosensitive source(s) of reducible silver ions, the reducing agent(s), toners, and any other thermographic layer additives are generally combined with one or more binders that are generally hydrophobic or hydrophilic in nature. Thus, either aqueous or organic solvent-based formulations can be used to prepare the thermographic materials. Mixtures of either or both types of binders can also be used.

Examples of typical hydrophobic binders include polyvinyl acetals, polyvinyl chloride, polyvinyl acetate, cellulose acetate, cellulose acetate butyrate, polyolefins, polyesters, polystyrenes, polyacrylonitrile, polycarbonates, methacrylate copolymers, maleic anhydride ester copolymers, butadiene-styrene copolymers, and other materials readily apparent to one skilled in the art. Copolymers (including terpolymers) are also included in the definition of polymers. The polyvinyl acetals (such as polyvinyl butyral and polyvinyl formal) and vinyl copolymers (such as polyvinyl acetate and polyvinyl chloride) are particularly preferred. Particularly suitable hydrophobic binders are polyvinyl butyral resins that are available under the names MOWITAL® (Kuraray America, New York, N.Y.), S-LEC® (Sekisui Chemical Company, Troy, Mich.), BUTVAR® (Solutia, Inc., St. Louis, Mo.) and PIOLOFORM® (Wacker Chemical Company, Adrian, Mich.).

Hydrophilic binders or water-dispersible polymeric latex polymers can also be present in the formulations. Examples of useful hydrophilic binders include, but are not limited to, proteins and protein derivatives, gelatin and gelatin-like derivatives (hardened or unhardened), cellulosic materials such as hydroxymethyl cellulose and cellulosic esters, acrylamide/methacrylamide polymers, acrylic/methacrylic polymers polyvinyl pyrrolidones, polyvinyl alcohols, poly(vinyl lactams), polymers of sulfoalkyl acrylate or methacrylates, hydrolyzed polyvinyl acetates, polyacrylamides, polysaccharides and other synthetic or naturally occurring vehicles commonly known for use in aqueous-based photographic emulsions (see for example, *Research Disclosure*, item 38957, noted above). Cationic starches can also be used as a peptizer for tabular silver halide grains as described in U.S. Pat. No. 5,620,840 (Maskasky) and U.S. Pat. No. 5,667,955 (Maskasky).

Water-dispersible hydrophobic polymers that are provided as polymer latexes can also be used as binders in minor amounts in the thermographic materials of this invention. Such materials are well known in the art including U.S. Pat. No. 6,096,486 (noted above).

Hardeners for various binders may be present if desired. Useful hardeners are well known and include diisocyanate compounds as described in EP 0 600 586 B1 (Philip, Jr. et al.) and U.S. Pat. No. 6,313,065 (Horsten et al.), vinyl sulfone compounds as described in U.S. Pat. No. 6,143,487 (Philip, Jr. et al.) and EP 0 640 589 A1 (Gathmann et al.), aldehydes and various other hardeners as described in U.S. Pat. No. 6,190,822 (Dickerson et al.). The hydrophilic binders used in the thermographic materials are generally partially or fully hardened using any conventional hardener. Useful hardeners are well known and are described, for example, in T. H. James, *The Theory of the Photographic Process*, Fourth Edition, Eastman Kodak Company, Rochester, N.Y., 1977, Chapter 2, pp. 77-8.

Where the proportions and activities of the thermographic materials require a particular developing time and temperature, the binder(s) should be able to withstand those conditions. When a hydrophobic binder is used, it is preferred that the binder (or mixture thereof) does not decompose or lose its structural integrity at 120° C. for 60 seconds. When a hydrophilic binder is used, it is preferred that the binder does not decompose or lose its structural integrity at 150° C. for 60 seconds. It is more preferred that it does not decompose or lose its structural integrity at 177° C. for 60 seconds.

The polymer binder(s) is used in an amount sufficient to carry the components dispersed therein. Preferably, a binder is used at a level of from about 10% to about 90% by weight (more preferably at a level of from about 20% to about 70% by weight) based on the total dry weight of the layer.

It is particularly useful in the direct thermographic materials to use predominantly (more than 50% by weight of total binder weight) hydrophobic binders in both imaging and non-imaging layers on both sides of the support. In particular, the outermost layers are generally formulated and disposed on the support with one or more hydrophobic binders such as cellulose ester polymer binders. Of these binders, cellulose nitrate, cellulose acetate, cellulose acetate butyrate, and cellulose acetate propionate are preferred.

Support Materials

The direct thermographic materials comprise a polymeric support that is preferably a flexible, transparent film that has any desired thickness and is composed of one or more polymeric materials, depending upon their use. The supports are generally transparent (especially if the material is used as a photomask) or at least translucent, but in some instances, opaque supports may be useful. They are required to exhibit dimensional stability during thermal imaging and development and to have suitable adhesive properties with overlying layers. Useful polymeric materials for making such supports include polyesters, cellulose acetate and other cellulose esters, polyvinyl acetal, polyolefins, polycarbonates, and polystyrenes. Preferred supports are composed of polyesters or polycarbonates, such as polyethylene terephthalate film.

Opaque supports can also be used, such as dyed polymeric films and resin-coated papers that are stable to high temperatures. Support materials can contain various colorants, pigments, and dyes if desired. For example, the support can contain conventional blue dyes that differ in absorbance from colorants in the various frontside or backside layers as described in U.S. Pat. No. 6,248,442 (Van Achere et al.). Support materials may be treated using conventional procedures (such as corona discharge) to improve adhesion of overlying layers, or subbing or other adhesion-promoting layers can be used.

The support thickness can be within the range of from about 2 to about 15 μm. Preferably, the support thickness is from about 4 to about 10 μm.

Protective Layer

The direct thermographic materials can have a non-thermally sensitive outermost protective layer (or "overcoat layer") on at least the imaging side of the support. Preferably, this protective layer is the outermost layer on the imaging side. A wide variety of materials are useful as binders or other components in such outermost protective layers as described in U.S. Pat. No. 5,536,696 (Horsten et al.), U.S. Pat. No. 5,817,598 (Defieuw et al.), and U.S. Pat. No. 6,313,065 (noted above). Such protective layers can include matte agents (organic or inorganic particles), "slip" agents, lubricants, pigments, "thermomeltable" particles, reinforcing agents, antistatic agents, conductive agents, coating aids, and tinting agents. It is particularly desired that the outermost protective layer have a dynamic coefficient of friction of less than 0.3 when the thermographic material is moved in contact and relative to an imaging means such as a thermal print-head. This "slip" property is usually provided by incorporating one or more lubricants into the outermost protective layer. The protective layer can include mixtures of lubricants such as one or more solid lubricants and one or more liquid lubricants.

In some embodiments, the thermographic materials comprise an outermost protective layer on the imaging side that comprises two or more specific lubricants from designated classes of compounds. The protective layer provides both protective and transport (or "slip") properties. Useful protective layers and their methods of preparation are described in copending and commonly assigned U.S. Ser. No. 10/767,757 (filed Jan. 28, 2004 by Kenney, Foster, and Johnson) incorporated herein by reference.

More particularly, the protective layer can comprise one or more lubricants from one or more of the following categories of compounds:

(a) solid polymers, each derived from one or more olefins and from one or more ethylenically unsaturated polymerizable carboxylic acids or esters or anhydrides thereof, (b) branched α-olefin polymers, (c) additional waxes other than compounds in categories of (a) and (b), and (d) silicone oils.

Preferably, the protective layer includes one or more silicone oils of category (d) and one or more compounds from any of the categories (a), (b), and (c), and more preferably at least one silicone oil of category (d) and a wax from category (a) or (c).

Category (a) includes solid polymers derived from one or more olefins and from one or more ethylenically unsaturated polymerizable carboxylic acids or ester or anhydrides thereof. Suitable polymers include those described in U.S. Pat. No. 3,590,076 (Heintzelman et al.) that is incorporated herein by reference in its entirety. The number average molecular weight of the solid polymer is generally from about 300 to about 5000. Mixtures of these solid polymers can be used.

More particularly, the solid polymer is a polyolefin derived from one or more α-olefin monomers, preferably each having 2 to 8 carbon atoms. Ethylene and/or propylene are especially preferred monomers.

Suitable ethylenically unsaturated polymerizable carboxylic acid monomers are those having from 3 to 12 carbon atoms, and preferably from 4 to 5 carbon atoms. Monomers that are dicarboxylic acids and anhydrides thereof are preferred. These include maleic acid, ethyl maleic acid, propyl maleic acid, isopropyl maleic acid, fumaric acid, methylene malonic acid, glutaconic acid, itaconic acid, methyl itaconic acid, mesaconic acid, and citraconic acid and their mixtures, as well as the corresponding esters, anhydrides, and mixtures of such acids, esters and anhydrides. Isopropyl maleic acid, esters and anhydrides therefore are especially preferred.

For example, a category (a) polymer includes maleic anhydride polyethylene, maleic acid anhydride polypropylene, iso-propylmaleate polyethylene, and iso-propylmaleate polypropylene graft copolymers.

Category (b) lubricants are branched α-olefin polymers or mixtures thereof. The branched hydrocarbon typically has a number average molecular weight (as measured by vapor pressure osmometry) of at least 300, preferably at least 400, and more preferably at least 500. It typically has a number average molecular weight of no more than 10,000, preferably no more than 5,000, and more preferably no more than 3,000, although the molecular weight can be outside of these ranges. The branched hydrocarbon typically has a melting point (for crystalline materials) or a softening point (for amorphous or semi-crystalline materials) of at least 30° C., preferably at least 35° C., and more preferably at least 50° C., and typically has a melting point or softening point of no more than 120° C., although the melting point can be outside of these ranges. The degree of branching (or average number of branches per molecule) in the branched hydrocarbon typically is from about 4 to about 5, and typically is no more than about 15 although the degree of branching can be outside of these ranges. The branched hydrocarbon can be saturated or unsaturated, and can include cyclic moieties. In addition, oxidized hydrocarbons, such as polyethylene-based oxidized materials and microcrystalline-based oxidized materials can be used, as can unsaturated and branched hydrocarbon-like molecules using as a core cyclic compounds or dendrimer or arborols.

Also suitable are homopolymers and copolymers prepared from monomers of the formula $R^dCH{=}CH_2$ wherein $R^d$ is a substituted or unsubstituted alkyl group having from 1 to 18 carbon atoms, and preferably from 3 to 12 carbon atoms, although the number of carbon atoms can be outside of these ranges. The polymerized α-olefin is also known as an olefin-derived hydrocarbon polymer or catalytically polymerized α-olefin.

These polymers can be prepared using for example, using the polymerization process described in U.S. Pat. No. 4,060,569 (Woods et al.) that is incorporated herein by reference.

Some polymerized α-olefins are commercially available for example, from the Baker Petrolite Corporation (Sugar Land, Tex.) under the tradename VYBAR®, that is available in solid (for example VYBAR® 103, VYBAR® 260) or liquid (for example VYBAR® 825) form.

Examples of suitable branched hydrocarbons include VYBAR® 253, a poly(α-olefin) having a number average molecular weight of about 520, a softening point of about 67° C. (measured by ASTM method D36) and a degree of branching of from about 5 to about 10. This polymer is based on an ethylene structure having pendant hydrocarbon side chains and is also referred to as a poly(α-olefin) or a poly(1-alkene). Also suitable for use are VYBAR® 103 having a number average molecular weight of about 4400, VYBAR® 260 having a number average molecular weight of about 2,600, and the VYBAR® X-series polymers, such as X-6044, X-6059, and X-6028. Also useful are oxidized hydrocarbons such as those available from Baker Petrolite Corp. as polyethylene-based oxidized materials and microcrystalline-based oxidized materials, such as the CARDIS® and PETRONAUBA® materials.

A particularly useful branched polyolefin is VYBAR® 103, CAS [68527-08-2] that is described as alkenes, macromonomers with greater than 10 carbon atoms that are α-polymerized and having a softening point of 74° C. (165.2° F.).

The third category (c) compounds include any suitable wax that will form a hydrophobic coating. Thus, animal, vegetable, mineral and synthetic waxes may be employed, as may be mixtures thereof.

Generally speaking, a wax is a substance that is a solid at ambient temperature and that has a low viscosity at just above its melting point. Typically, a wax is a substance having the following properties: (1) crystalline to microcrystalline structure, (2) capacity to acquire gloss when rubbed (as distinct from greases), (3) capacity to produce pastes or gels with suitable solvents or when mixed with other waxes, (4) low viscosity at just above the melting point. See *Grant & Hackh's Chemical Dictionary* ($5^{th}$ Edition), page 628, hereby incorporated by reference. Waxes differ from fats in that fats are esters of trihydric lower alcohols.

The following components are illustrative types of both synthetically prepared and naturally occurring waxes:

Useful mineral waxes include but are not limited to paraffin (26-30 carbon atom aliphatic hydrocarbons), microcrystalline waxes (41-50 carbon atom branched chain hydrocarbons), oxidized microcrystalline waxes (hydrocarbons, esters, fatty acids), montan (waxing acids, alcohols, ester, and ketones), Hoechst waxes (oxidized montan wax), and ozokerite waxes (high molecular weight aliphatic and alkenyl hydrocarbons).

Useful vegetable waxes include but are not limited to, carnauba wax (complex alcohols and hydrocarbons), esparto, flax, and sugarcane waxes (fatty acid esters, aldehydes, esters, alcohols, hydrocarbons), and candelilla waxes (hydrocarbons, acids, esters, alcohols, and lactones).

Useful animal waxes include but are not limited to beeswax.

Useful synthetic waxes include but are not limited to polyolefins derived from one or more olefins.

One preferred additional wax is the fully saturated homopolymer of a low molecular weight polyethylene (such as a low molecular weight polyolefin), or copolymers of various alkene monomers that form polymers with a molecular weight at or below 3,000, a melting point below 130° C., and low melt viscosities. Applicable waxes could include POLYWAX® that is available from Baker Petrolite Corp. Another preferred wax is carnuba wax available as a dispersion from Elementis Specialties (Hightstown, N.J.) under the name Slip-Ayd® SL 508.

In preferred embodiments, component (c) is a microcrystalline wax, carnauba wax, petronauba wax, paraffin wax, candelilla wax, or a linear low molecular weight polyethylene.

POLYWAX® is a linear polyethylene wax. A particularly preferred wax is POLYWAX® 400, CAS [9002-88-4], described as polyethylene homopolymer with weight average molecular weight of about 450 and a melting point of 81° C. (177.8° F.). Additional information on this material can be found at the website for POLYWAX® 400:
<http/www.bakerhughes.corn/bakerpetrolite/polymers/ethylene_homopolymers.htm>.

Silicone oils useful in category (d) include poly(diphenylphenyl-methylsiloxane), poly(diphenylsiloxane), poly(methylethylsiloaxane), poly(methylbutylsiloxane), poly(methylhexylsiloxane), and polydimethylsiloxane. Silicone oils can also possess a variety of terminating groups, including trimethylsilyl, distearate, perfluorooctadecyl, and aminopropyl. Particularly preferred silicone oils are aminopropyl terminated poly(dimethylsiloxane)s that are available from Gelest, Inc (Morrisville, Pa.).

The total amount of lubricants in the protective layer is generally of from about 0.01 to about 1.5 $g/m^2$ and preferably from about 0.08 to about 0.3 $g/m^2$.

One or more binders may also be used in the protective layer. In preferred embodiments, polymeric thermoplastic binders are employed. Examples of such materials include but are not limited to, poly(styrene-co-acrylonitrile) (for example a 70/30 monomer weight ratio), poly(vinyl alcohol-co-butyral) (available commercially as BUTVAR® B-79 or S-LEC® BL5Z or MOWITAL® SB45H), poly(vinyl alcohol-co-acetal), poly(vinyl alcohol-co-benzal), polystyrene, poly(vinyl acetate), cellulose acetate butyrate (available commercially as CAB 171-15), cellulose acetate propionate, cellulose acetate, ethyl cellulose, cellulose triacetate, poly(methyl methacrylate), and copolymers derived from methyl methacrylate. In preferred embodiments of the invention, the binder is CAB 171-15.

The amount of the binder(s) present in the protective layer is generally in an amount of from about 50 to about 95 weight % of the total protective layer.

The protective layer can also contain matting agents such as particles of starch, titanium dioxide, zinc oxide, silica, calcium carbonate, and polymeric beads including beads of the type described in U.S. Pat. No. 2,992,101 (Jelley et al.) and U.S. Pat. No. 2,701,245 (Lynn). The matting agents can be composed of any useful material and may have a size in relation to the protective layer thickness that enables them to protrude through the outer surface of the protective layer, as described for example, in U.S. Pat. No. 5,536,696 (noted above). If matting agents are present, they generally comprise from about 0.2 to about 10 dry weight % of the protective layer. It may be desirable that the outermost protective layer that is in contact with thermal imaging means has a dynamic coefficient of friction less than 0.3 as described in U.S. Pat. No. 5,817,598 (noted above), incorporated herein by reference for the measurement of coefficient of friction. This may be accomplished with an appropriate use of lubricants and matting agents as one skilled in the art would readily understand.

Polymeric fluorinated surfactants may also be useful in the protective layer as described in U.S. Pat. No. 5,468,603 (Kub).

In addition, nanometer size particles can be used as reinforcing agents in the protective layer. Such particles are described in for example, in U.S. Patent Application Publication 2004/0198602 (Pham) that is incorporated herein by reference.

In general, the outermost protective layer has a dry thickness of from about 0.1 to about 10 μm. Preferably the protective layer dry thickness is from about 1 to about 6 μm, and more preferably, it is from about 2 to about 5 μm.

Thermographic Formulations and Constructions

An organic-based formulation for the thermographic emulsion layer(s) can be prepared by dissolving and dispersing the binder, the source of non-photosensitive silver ions, the reducing agent, and optional addenda in an organic solvent, such as toluene, 2-butanone (methyl ethyl ketone), acetone, methanol, or tetrahydrofuran (or mixtures thereof).

Alternatively, the desired imaging components can be formulated with a hydrophilic binder (such as gelatin, a gelatin-derivative, or a latex) in water or water-organic solvent mixtures to provide aqueous-based coating formulations.

The direct thermographic materials can contain plasticizers and lubricants such as poly(alcohols) and diols as described in U.S. Pat. No. 2,960,404 (Milton et al.), fatty acids or esters as described in U.S. Pat. No. 2,588,765 (Robijns) and U.S. Pat. No. 3,121,060 (Duane), and silicone resins as described in GB 955,061 (DuPont). The materials can also contain inorganic and organic matting agents as described in U.S. Pat. No. 2,992,101 (Jelley et al.) and U.S. Pat. No. 2,701,245 (Lynn). Polymeric fluorinated surfactants may also be useful in one or more layers as described in U.S. Pat. No. 5,468,603 (noted above).

The direct thermographic materials can include one or more antistatic agents in any of the layers on either or both sides of the support. Conductive components include soluble salts, evaporated metal layers, or ionic polymers as described in U.S. Pat. No. 2,861,056 (Minsk) and U.S. Pat. No. 3,206,312 (Sterman et al.), insoluble inorganic salts as described in U.S. Pat. No. 3,428,451 (Trevoy), polythiophenes as described in U.S. Pat. No. 5,747,412 (Leenders et al.), electro-conductive underlayers as described in U.S. Pat. No. 5,310,640 (Markin et al.), electronically-conductive metal antimonate particles as described in U.S. Pat. No. 5,368,995 (Christian et al.), and electrically-conductive metal-containing particles dispersed in a polymeric binder as described in EP 0 678 776 A1 (Melpolder et al.). Particularly useful conductive particles are the non-acicular metal antimonate particles used in a buried backside conductive layer as described in U.S. Pat. No. 6,689,546 (LaBelle et al.), and in copending and commonly assigned U.S. Ser. No. 10/930,428 (filed Aug. 31, 2004 by Ludemann, LaBelle, Koestner, Hefley, Bhave, Geisler, and Philip), Ser. No. 10/930,438 (filed Aug. 31, 2004 by Ludemann, LaBelle, Philip, Koestener, and Bhave), Ser. No. 10/978,205 (filed Oct. 29, 2004 by Ludemann, LaBelle, Koestner, and Chen), Ser. No. 10/999,858 (filed Nov. 30, 2004 Ludemann, Koestner, LaBelle, and Philip), and Ser. No. 11/000,115 (filed Nov. 30, 2004 by Ludemann, LaBelle, Philip, and Geisler). All of the above patents and patent applications are incorporated herein by reference.

In addition to the conductive particles described above, other conductive materials may be present in either the buried conductive backside layer or other backside layers. Such compositions include fluorochemicals that are described in U.S. Pat. No. 6,699,648 (Sakizadeh et al.) and U.S. Pat. No. 6,762,013 (Sakizadeh et al.). Both of these patents are incorporated herein by reference.

The thermographic materials may also usefully include a magnetic recording material as described in *Research Disclosure*, Item 34390, November 1992, or a transparent magnetic recording layer such as a layer containing magnetic particles on the underside of a transparent support as described in U.S. Pat. No. 4,302,523 (Audran et al.), incorporated herein by reference.

The thermographic materials can be constructed of two or more layers on the imaging side of the support. Two-layer materials would include a single thermographic imaging layer and an outermost protective overcoat layer. The single thermographic imaging layer would contain the non-photosensitive source of reducible silver ions, the reducing agent, the binder, as well as optional materials such as toners, coating aids, and other adjuvants.

Three-layer constructions comprising two thermographic imaging layer coatings containing the ingredients and an outermost protective layer are generally found on the frontside of the materials.

Layers to promote adhesion of one layer to another in thermo-graphic materials are also known, as described in U.S. Pat. No. 5,891,610 (Bauer et al.), U.S. Pat. No. 5,804,365 (Bauer et al.), and U.S. Pat. No. 4,741,992 (Przezdziecki). Adhesion can also be promoted using specific polymeric adhesive materials as described in U.S. Pat. No. 5,928,857 (Geisler et al.) all incorporated herein by reference.

Layers to reduce emissions from the film may also be present, including the polymeric barrier layers described in U.S. Pat. No. 6,352,819 (Kenney et al.), U.S. Pat. No. 6,352,820 (Bauer et al.), U.S. Pat. No. 6,420,102 (Bauer et al.), U.S. Pat. No. 6,746,831 (Hunt), and in U.S. Patent Application Publication 2004/0126719 (Geuens et al.), all incorporated herein by reference.

Layer formulations described herein can be coated by various coating procedures including wire wound rod coating, dip coating, air knife coating, curtain coating, slide coating, or extrusion coating using hoppers of the type described in U.S. Pat. No. 2,681,294 (Beguin). The formulations can be coated one at a time, or two or more formulations can be coated simultaneously by the procedures described in U.S. Pat. No. 2,761,791 (Russell), U.S. Pat. No. 4,001,024 (Dittman et al.), U.S. Pat. No. 4,569,863 (Keopke et al.), U.S. Pat. No. 5,340,613 (Hanzalik et al.), U.S. Pat. No. 5,405,740 (LaBelle), U.S. Pat. No. 5,415,993 (Hanzalik et al.), U.S. Pat. No. 5,525,376 (Leonard), U.S. Pat. No. 5,733,608 (Kessel et al.), U.S. Pat. No. 5,849,363 (Yapel et al.), U.S. Pat. No. 5,843,530 (Jerry et al.), and U.S. Pat. No. 5,861,195 (Bhave et al.), and GB 837,095 (Ilford). A typical wet coating thickness for the emulsion layer can be from about 10 to about 750 μm, and the layer can be dried in forced air at a temperature of from about 20° C. to about 100° C. It is preferred that the thickness of the layer be selected to provide maximum image densities greater than about 0.2, and more preferably, from about 0.5 to 5.0 or more, as measured by an X-rite Model 361/V Densitometer equipped with 301 Visual Optics.

When the layers are coated simultaneously using various coating techniques, a "carrier" layer formulation comprising a single-phase mixture of the two or more polymers described above may be used as described in U.S. Pat. No. 6,436,622 (Geisler), incorporated herein by reference.

Mottle and other surface anomalies can be reduced in the materials of this invention by incorporation of a fluorinated polymer as described in U.S. Pat. No. 5,532,121 (Yonkoski et al.) or by using particular drying techniques as described in U.S. Pat. No. 5,621,983 (Ludemann et al.).

Preferably, two or more layers are simultaneously applied to a film support using slide coating techniques by coating the first layer on top of the second layer while the second layer is still wet using the same or different coating fluids or solvent mixtures.

While the first and second layers can be coated on one side of the film support, manufacturing methods can also include forming on the opposing or backside of said polymeric support, one or more additional layers, including an outermost protective layer.

It is preferred that the conductive layers be disposed on the backside of the support and especially where it is buried or underneath one or more other layers such as backside protective layer(s). Such backside conductive layers typically have a water electrode resistivity (WER) of about $10^5$ to about $10^{12}$ ohm/sq. This technique is described in R. A. Elder *Resistivity Measurements on Buried Conductive Layers*, EOS/ESD Symposium Proceedings, Lake Buena Vista, Fla., 1990, pp. 251-254, [EOS/ESD stands for Electrical Overstress/Electrostatic Discharge].

Preferably, the backside conductive layer comprises non-acicular metal antimonate particles composed of $ZnSb_2O_6$. Several conductive metal antimonates are commercially available from Nissan Chemical Industry, Ltd. (Japan) under the tradename CELNAX® CX-Z401M. The metal antimonate particles in the conductive layer are predominately (more than 50% by weight of total particles) in the form of clusters of non-acicular particles as opposed to "acicular" particles. By "non-acicular" particles is meant not needle-like, that is, not acicular. Preferably the metal antimonate is of $ZnSb_2O_6$.

The conductive layer is generally coated out of one or more miscible organic solvents including, but not limited to, methyl ethyl ketone (2-butanone, MEK), acetone, toluene, tetrahydrofuran, ethyl acetate, ethanol, methanol, or any mixture of any two or more of these solvents. Alternatively, the conductive layer can be coated using aqueous solvents and hydrophilic binder or a polymer latex.

As noted above, the conductive layer also includes one or more binder materials that are usually polymers that are generally soluble or dispersible in the organic solvents noted above. The polyvinyl acetals, polyesters, cellulosic ester polymers, and vinyl polymers such as polyvinyl acetate and polyvinyl chloride are particularly preferred, and the polyvinyl acetals, polyesters, and cellulosic ester polymers are more preferred. Blends of these various polymers can also be used to advantage in the conductive layer.

Imaging/Development

The direct thermographic materials can be imaged in any suitable manner consistent with the type of material using any suitable source of thermal energy. The image may be "written" simultaneously with development at a suitable temperature using a thermal stylus, a thermal print-head, or a laser, or by heating the material as it is moved while in contact with a heat absorbing material. The thermographic materials may include a dye (such as an IR-absorbing dye) to facilitate direct development by exposure to laser radiation. The dye converts absorbed radiation to heat. Thermal development is carried out with the materials being in a substantially water-free environment and without application of any solvent to the materials.

Use as a Photomask

The direct thermographic materials are sufficiently transmissive in the range of from about 350 to about 450 nm in non-imaged areas to allow their use in a method where there is a subsequent exposure of an ultraviolet or short wavelength visible radiation sensitive imageable medium. For example, imaging the materials affords a visible image. The thermographic materials absorb ultraviolet or short wavelength visible radiation in the areas where there is a visible image and transmit ultraviolet or short wavelength visible radiation where there is no visible image. The materials may then be used as a mask and positioned between a source of imaging radiation (such as an ultraviolet or short wavelength visible radiation energy source) and an imageable material that is sensitive to such imaging radiation, such as a photopolymer, diazo material, photoresist, or photosensitive printing plate. Exposing the imageable material to the imaging radiation through the visible image in the thermographic material provides an image in the imageable material. This method is particularly useful where the imageable medium comprises a printing plate and the thermographic material serves as an imagesetting film.

The following examples are provided to illustrate the practice of the present invention and the invention is not meant to be limited thereby.

Materials and Methods for the Examples:

All materials used in the following examples can be prepared using known synthetic procedures or are available from standard commercial sources, such as Aldrich Chemical Co. (Milwaukee, Wis.), unless otherwise specified. All percentages are by weight unless otherwise indicated. Many of the chemical components used herein are provided as a solution. The term "active ingredient" means the amount or the percentage of the desired material contained in a sample. All amounts listed herein are the amount of active ingredient added unless otherwise specified. The following additional materials were prepared and used.

ALBACAR 5970 is a 1.9 μm precipitated calcium carbonate. It is available from Specialty Minerals, Inc. (Bethlehem, Pa.).

BUTVAR® B-79 is a polyvinyl butyral resin available from Solutia, Inc; (St. Louis, Mo.).

CAB 171-15 and CAB 381-20 are cellulose acetate butyrate resins available from Eastman Chemical Co. (Kingsport, Tenn.).

MEK is methyl ethyl ketone (or 2-butanone).

PARALOID® A-21 is an acrylic copolymer available from Rohm and Haas (Philadelphia, Pa.).

PIOLOFORM® BL-16 and BS-18 are polyvinyl butyral resins available from Wacker Polymer Systems (Adrian, Mich.).

PS512 is an aminopropyldimethyl terminated polydimethylsiloxane available from United Chemical Technologies (Bristol, Pa.).

Optical Densities were measured using an X-Rite Model 361T Densitometer (X-Rite Incorporated, Grandville, Mich.).

Color measurement such as L, a*, and b* values were measured by HunterLab UltraScan (Hunter Associates Laboratory, Inc., Reston, Va.). These values were determined using CIELAB standards described above.

Developer D-1 is 2,3-dihydroxybenzoic acid.

Developer D-2 is 1,2-dihydroxybenzene (catechol).

Developer D-3 is 3,4-dihydroxybenzonitrile.

Preparation of Catechol Borate Compounds

Preparation of Compound CB-1:

Lithium hydroxide monohydrate (0.839 g, 0.02 mmol), boric acid (1.236 g, 0.02 mmol), and 2 equivalents of 3,4-dihydroxybenzonitrile (5.4 g, 0.04 mmol) were mixed in 4 ml water. The mixture was heated to near boiling for few minutes till a clear pink colored solution was obtained. Upon cooling to room temperature a white solid was formed. The supernatant solution was decanted and the solid was recrystallized from small quantity of hot water. After drying in an oven, lithium bis(3,4-dihydroxybenzonitrile) borate was isolated as a white powder. Yield=5.3 g (93%), mp>300° C.

Preparation of Compound CB-2:

Lithium bis(3,4-dihydroxybenzonitrile)borate (5.68 g, 0.02 mmol) was dissolved in 15 ml warm water. A solution of 4.75 g (0.02 mmol) of tetraethylammonium chloride in 5 ml water was added and the mixture was stirred and heated to near boiling for about 10 minutes. Upon cooling to room temperature, a white precipitate was formed which was separated by decanting and re-crystallized from hot water to give 6.3 g (77%) of tetraethylammonium bis(3,4-dihydroxybenzonitrile)borate, mp=162-163° C. The structure was confirmed by GC-MS.

Preparation of Compound CB-3:

Lithium bis(3,4-dihydroxybenzonitrile)borate (2.83 g, 0.01 mmol) was dissolved in 10 ml warm water. A solution of 3.145 g (0.01 mmol) of methyl-tributylammonium chloride (wt. 75% solution in water) was added and the mixture was stirred and heated to near boiling for about 10-15 minutes. Upon cooling to room temperature, a white crystalline precipitate was separated. This was filtered off, washed with water (2×10 ml) and recrystallized from acetone-water twice following by drying in a vacuum oven at 60° C. to give 3.4 g (72%) of methyl-tributylammonium bis(3,4-dihydroxybenzonitrile)borate, mp=155° C. The structure was confirmed by GC-MS.

Preparation of Compound CB-4:

This compound was prepared in one pot reaction without isolation of the intermediate. Lithium hydroxide monohydrate (0.839 g, 0.02 mmol), boric acid (1.236 g, 0.02 mmol), and 2 equivalents of 3,4-dihydroxybenzonitrile (5.4 g, 0.04 mmol) were mixed in 4 ml water. The mixture was heated to near boiling for few minutes till a clear pink color solution was obtained. Upon cooling to room temperature a white solid was formed. The supernatant solution was decanted and precipitate was dissolved in 15 ml warm water. To this was added a solution of 6.96 g (0.02 mmol) of octadecyltrimethylammonium chloride in water (80 ml) and the mixture was stirred and heated to near boiling for about 15 minutes. Upon cooling to room temperature, a fine precipitate was formed. This was separated from the liquid by a centrifuge and re-crystallized by dissolving in 120 ml of boiling acetone and 10 ml of water following by drying in a vacuum oven at 60° C. to give 10.2 g (86%) of octadecyltrimethylammonium bis(3,4-dihydroxy-benzonitrile)borate, mp=124° C. The structure was confirmed by GC-MS.

Preparation of Compound CB-5:

This compound was prepared in one pot reaction flask as described above but starting with 3,4-dihydroxybenzonitrile (5.4 g, 0.04 mmol). A solution of tetrabutylammonium chloride (5.56 g, 0.02 mmol) in water (15 ml) was used instead of octadecyltrimethylammonium chloride. The crude product was recrystallized from hot isopropyl alcohol/water (100 ml/50 ml). Filtration, followed by drying in a vacuum oven at 60° C. gave 8.2 g (79%) of tetrabutyl-ammonium bis(3,4-dihydroxybenzonitrile)borate, mp=140° C. The structure was confirmed by GC-MS.

Preparation of Compound CB-6:

3,4-Dihydroxybenzophenone (5.355 g, 0.025 mmol), lithium hydroxide monohydrate (0.524 g, 0.0125 mmol), and boric acid (0.773 g, 0.0125 mmol) were mixed in water and heated to near boiling for about 15 minutes. The crude product was then crystallized from ethyl acetate/n-heptane to give 5.0 g (90%) of lithium bis(3,4-dihydroxybenzophenone)borate as a gray colored (ash-like) powder after drying in an oven at 90° C., mp>310° C. The structure was confirmed by GC-MS.

Preparation of Compound CB-7:

2,3-Dihydroxynaphthalene (3.2 g, 0.02 mmol), lithium hydroxide monohydrate (0.42 g, 0.01 mmol), and boric acid (0.62 g, 0.01 mmol) were mixed in 10 ml water and heated to near boiling for about 15 minutes with mixing. Upon cooling to room temperature, a reddish-burgundy color solid was formed which was filtered off, washed with 10 ml of cold water, recrystallized from hot isopropyl alcohol, and dried in an oven at 90° C. to give 2.7 g (80%) of lithium bis(2,3-dihydroxynaphthalene)borate as micro needle crystals, mp>300° C.

The following examples demonstrate the use of catechol borate reducing agents in thermographic materials according to this invention.

EXAMPLE 1

Preparation of Thermographic Materials

Silver Soap Homogenate Formulation:

A silver soap thermographic homogenate formulation was prepared with the following components.

| | |
|---|---|
| MEK | 75.5 parts |
| Silver Behenate | 24.0 parts |
| PIOLOFORM ® BL-16 | 0.5 parts |

The materials were mixed and homogenized by passing twice through a homogenizer at 5000 psi (352 kg/cm 2). The materials were cooled between the two passes.

Thermographic Emulsion Formulation:

To 52.0 g of the silver behenate homogenate at 24.5% solids was added 52.0 g of MEK, 10 g of methanol, 0.84 g of 4-hydroxyphthalic acid, and 0.11 g of tetrachlorophthalic acid. The resulting dispersion was stirred for 15 minutes at 1300 rpm. To this dispersion was added 2.40 g of 1-(2H)-phthalazinone. Stirring for 30 minutes was followed by addition of 31.16 g of BUTVAR® B-79. Stirring was maintained for an additional 60 minutes.

The compounds (0.00477 mol) shown below in TABLE I were evaluated as developers. Each compound was added to an emulsion formulation prepared above and mixed for 30 minutes. Comparative samples incorporating 3,4-dihydroxy benzonitrile were also prepared.

Preparation of Protective Overcoat Formulation:

A protective overcoat formulation was prepared by mixing the following materials:

| | |
|---|---|
| MEK | 62.77 parts |
| CAB 171-15 | 12.11 parts |
| PARALOID ® A-21 | 1.65 parts |
| PS512 | 0.39 parts in |
| | 2.17 parts of MEK |

-continued

| | |
|---|---|
| ALBACAR 5970 | 0.93 parts in<br>19.98 parts of MEK |

Each thermographic emulsion layer and protective overcoat layer formulations were coated onto 7 mil (178 μm) blue tinted polyethylene terephthalate support. A conventional, laboratory scale, dual-knife coater was used. Samples were dried in an oven at 185° F. (85° C.) for 7 minutes. The coating weight of the thermographic emulsion layer was 1.53 g/ft$^2$ (16.46 g/m$^2$). The coating weight of the protective layer was 0.25 g/ft$^2$ (2.69 g/m$^2$).

The resulting thermographic sheets were imaged with an AGFA DryStar™ Model 2000 printer. A test pattern was used. All samples gave several levels of gray and a black image.

The results, shown below in TABLE I, demonstrate that catechol borate reducing agents provide thermographic materials with low Dmin, and high Dmax. The a* and b* values indicate a neutral black image. In comparison, the very negative b* value for Developer D-2 (Sample 1-7-C), indicates catechol provides a very blue image.

TABLE I

Initial Sensitometry

| Sample | Compound | $D_{min}$ | $D_{max}$ | a* | b* |
|---|---|---|---|---|---|
| 1-1 | (CB-1) | 0.25 | 3.20 | −3.00 | −1.60 |
| 1-2 | (CB-2) | 0.26 | 3.30 | −1.20 | −1.80 |
| 1-3 | (CB-3) | 0.26 | 3.40 | −1.60 | −4.79 |
| 1-4 | (CB-4) | 0.26 | 2.90 | −0.40 | −3.20 |
| 1-5 | (CB-11) | 0.26 | 3.82 | −2.00 | −3.38 |
| 1-6 | (CB-11) + (D-1) | 0.28 | 3.78 | −2.70 | −6.70 |
| 1-7-C | (D-2) | 0.25 | 3.73 | −2.49 | −14.84 |
| 1-8-C | (D-3) | 0.26 | 2.66 | −3.30 | −2.40 |

a* and b* were determined at a Density of 1.2.

The samples prepared above were evaluated for accelerated aging by placing them in a sealed envelope, heating in an oven at 160° F. (71° C.) for 3 hours and remeasuring their sensitometry. The results, shown below in TABLES II and III, demonstrate that the catechol borate reducing agents described herein provide dense black silver image under the short time and high temperature conditions that occur when using thermal print-heads during thermal printing. These materials show little change in Dmin, Dmax, tint, and tone upon storage. In particular, a comparison of the Δa* and Δb* values of Developer CB-1 and Developer D-3 (Sample 1-8-C) indicate the catechol borate reducing agents provide less change in tone upon aging. Similar results are seen by comparing Developer CB-11 and Developer D-2 (Sample 1-7-C, catechol).

TABLE II

Sensitometry After Accelerated Aging

| Sample | Compound | $D_{min}$ | $D_{max}$ | a* | b* |
|---|---|---|---|---|---|
| 1-1 | (CB-1) | 0.26 | 3.09 | −3.20 | −2.60 |
| 1-2 | (CB-2) | 0.27 | 3.43 | 1.53 | 3.55 |
| 1-3 | (CB-3) | 0.27 | 3.42 | 1.20 | −0.53 |
| 1-4 | (CB-4) | 0.26 | 3.03 | 4.32 | 8.15 |
| 1-5 | (CB-11) | 0.30 | 4.64 | 7.65 | 13.39 |
| 1-6 | (CB-11) + (D-1) | 0.30 | 4.47 | 5.26 | 14.54 |
| 1-7-C | (D-2) | 0.27 | 4.63 | 11.92 | 24.43 |
| 1-8-C | (D-3) | 0.27 | 2.67 | 0.17 | −1.12 |

a* and b* were determined at a Density of 1.2.

TABLE III

Change in Sensitometry After Accelerated Aging

| Sample | Compound | $\Delta D_{min}$ | $\Delta D_{max}$ | Δa* | Δb* |
|---|---|---|---|---|---|
| 1-1 | (CB-1) | +0.01 | −0.11 | −0.20 | −1.00 |
| 1-2 | (CB-2) | +0.01 | +0.13 | +2.73 | +5.35 |
| 1-3 | (CB-3) | +0.01 | +0.02 | +2.80 | +4.26 |
| 1-4 | (CB-4) | 0.00 | +0.13 | +4.72 | +11.25 |
| 1-5 | (CB-11) | +0.04 | +0.82 | +9.65 | +16.77 |
| 1-6 | (CB-11) + (D-1) | +0.02 | +0.69 | +7.96 | +21.24 |
| 1-7-C | (D-2) | +0.02 | +0.90 | +14.41 | +39.27 |
| 1-8-C | (D-3) | +0.01 | +0.01 | +3.47 | +1.28 |

a* and b* were determined at a Density of 1.2.

The invention has been described in detail with particular reference to preferred embodiments thereof, but it will be understood that variations and modifications can be effected within the spirit and scope of the invention.

The invention claimed is:

1. A black and white non-photosensitive direct thermographic material comprising a support and on one or both sides thereof, one or more thermally sensitive imaging layers having in reactive association, a non-photosensitive source of reducible silver ions and a catechol borate reducing agent for said reducible silver ions.

2. The black and white non-photosensitive direct thermographic material of claim 1 wherein said catechol borate reducing agent is represented by the following Structure (I):

(I)

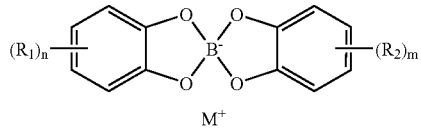

wherein $R_1$ or $R_2$ independently represent hydrogen or a monovalent substituent, or adjacent $R_1$ or $R_2$ represent the number of atoms necessary to form a 5- or 6-membered ring, n and m independently represent an 0 or an integer from 1 to 4, and $M^+$ represents a metal cation or an ammonium cation.

3. The black and white non-photosensitive direct thermographic material of claim 1 wherein $M^+$ is an alkali metal cation.

4. The black and white non-photosensitive direct thermographic material of claim 3 wherein $M^+$ is $Li^+$.

5. The black and white non-photosensitive direct thermographic material of claim 1 wherein $R_1$ and $R_2$ are independently halo, nitro, cyano, alkylsulfonyl, or arylsulfonyl groups.

6. The black and white non-photosensitive direct thermographic material of claim 1 wherein both of $R_1$ and $R_2$ are cyano.

7. The black-and-white non-photosensitive direct thermographic material of claim 1 wherein said catechol borate is one or more of the following Compounds CB-1 through CB-16:

(CB-1)
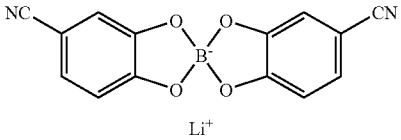
(CB-2)
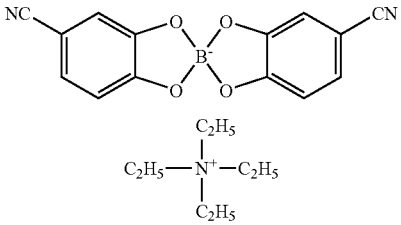
(CB-3)
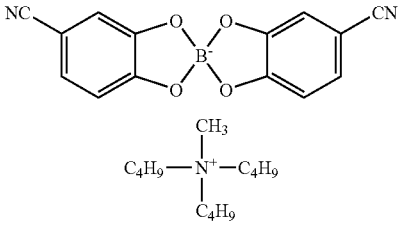
(CB-4)
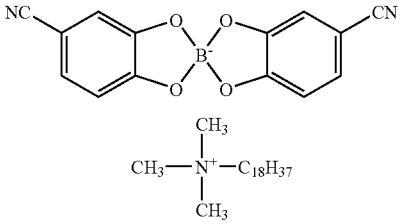
(CB-5)
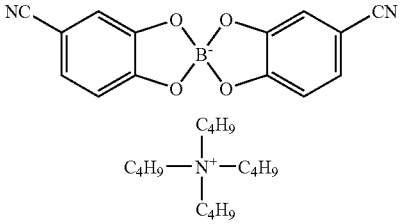
(CB-6)
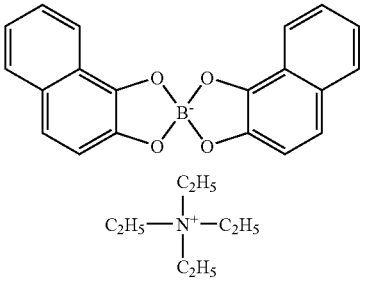
(CB-7)
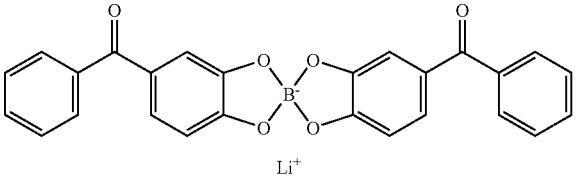
-continued
(CB-8)
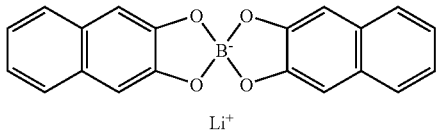
(CB-9)
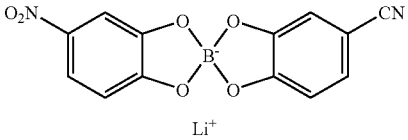
(CB-10)
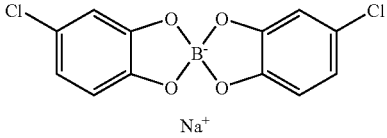
(CB-11)
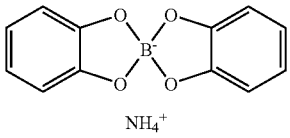
(CB-12)
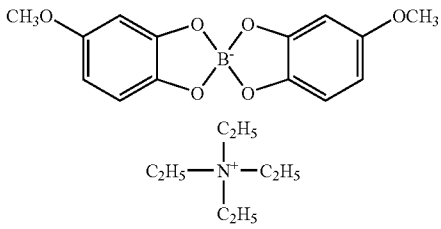
(CB-13)
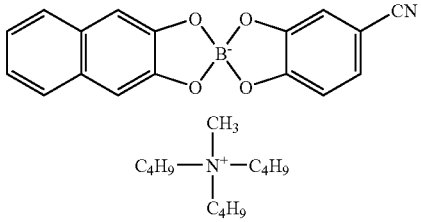
(CB-14)
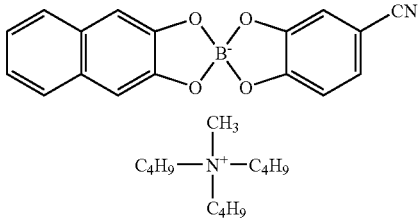
(CB-15)
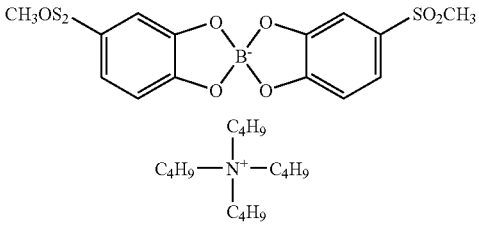

-continued (CB-16)

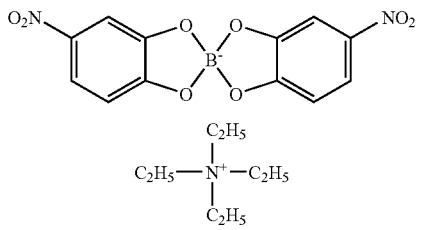

8. The material of claim 1 wherein said reducing agent and said non-photosensitive source of reducible silver ions are in the same thermally sensitive imaging layer.

9. The material of claim 1 wherein said non-photosensitive source of reducible silver ions includes one or more silver carboxylates, one of which is highly crystalline silver behenate.

10. The material of claim 1 wherein said one or more thermally sensitive imaging layers further comprises one or more aliphatic or aromatic polycarboxylic acids.

11. The material of claim 1 further comprising a non-thermally sensitive protective overcoat disposed on said one or more thermally sensitive imaging layers.

12. The material of claim 11 wherein said protective overcoat layer is the outermost layer of said material and comprises matte particles and one or more lubricants from any of the following categories (a), (b), (c) and (d):

(a) solid polymers, each derived from one or more olefins and from one or more ethylenically unsaturated polymerizable carboxylic acids or esters or anhydrides thereof, (b) branched α-olefin polymers, (c) additional waxes other than compounds in categories of (a) and (b), and (d) silicone oils.

13. The material of claim 1 wherein said support is transparent.

14. The material of claim 1 further comprising a conductive layer on the backside of said support.

15. The material of claim 14 wherein said conductive layer comprises non-acicular metal antimonate particles composed of $ZnSb_2O_6$.

16. The material of claim 1 further comprising a toner.

17. A method comprising imaging the direct thermographic material of claim 1 with a thermal imaging source to provide a visible image.

18. The method of claim 17 wherein said imaging is carried out using a thermal print-head when said thermographic material is moved in contact with and relative to said thermal print-head.

19. The method of claim 18 wherein said visible image is used for medical diagnostic purposes.

20. A black and white non-photosensitive direct thermographic material comprising a transparent support and on the frontside thereof, one or more thermally sensitive imaging layers having in reactive association, a non-photosensitive source of reducible silver ions that includes one or more silver carboxylates, one of which is silver behenate, a catechol borate reducing agent represented by the following Structure (I):

(I)

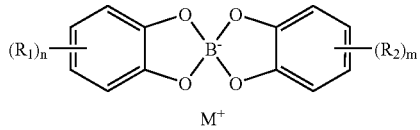

wherein $R_1$ and $R_2$ are independently halo, nitro, cyano, alkylsulfonyl, or arylsulfonyl groups, n and m are both 1, and $M^+$ represents alkali metal cation, an overcoat layer that is the outermost layer of said material and comprises matte particles, one or more silicone oils of category (d), and one or more compounds from any of the following categories (a), (b), and (c):

(a) solid polymers, each derived from one or more olefins and from one or more ethylenically unsaturated polymerizable carboxylic acids or esters or anhydrides thereof, (b) branched α-olefin polymers, (c) additional waxes other than compounds in categories of (a) and (b), and (d) silicone oils, and having a conductive layer comprising non-acicular metal antimonate particles composed of $ZnSb_2O_6$ on the backside side of said transparent support.

* * * * *